United States Patent [19]

Evans

[11] 3,980,977

[45] Sept. 14, 1976

[54] SPIRAL OPERATING MECHANISM FOR HIGH VOLTAGE SWITCH

[75] Inventor: David M. Evans, Palatine, Ill.

[73] Assignee: S & C Electric Company, Chicago, Ill.

[22] Filed: Apr. 1, 1975

[21] Appl. No.: 563,964

[52] U.S. Cl. ..... 335/76; 310/103; 335/74

[51] Int. Cl.[2] ..... H01H 3/00; H01H 9/00; H01H 51/00

[58] Field of Search ..... 335/74, 75, 76; 310/103; 307/142; 200/153 G

[56] References Cited

UNITED STATES PATENTS

| | | | |
|---|---|---|---|
| 3,236,967 | 2/1976 | Bottonari et al. | 335/76 X |
| 3,324,285 | 6/1967 | Foti et al. | 335/75 X |
| 3,652,815 | 3/1972 | Davies | 335/76 X |
| 3,689,720 | 9/1972 | Patel | 335/76 X |
| 3,689,721 | 9/1972 | McGuffie | 335/76 X |
| 3,773,995 | 11/1973 | Davies | 335/76 X |
| 3,789,172 | 1/1974 | Cole et al. | 335/76 X |

*Primary Examiner*—J. D. Miller
*Assistant Examiner*—Fred E. Bell
*Attorney, Agent, or Firm*—Kirkland & Ellis

[57] ABSTRACT

A spiral spring interconnects a pivotably mounted drive lever that may be pivoted either by hand or by a motor, and a pivotably mounted toggle lever that is operably connected to a switch. The toggle lever is held in the switch-closed or the switch-opened positions by main latches which hold the toggle lever in position while the drive lever is pivoted to bias the spring. Once the spring is biased, stop latches engage the drive lever holding it in a spring biased position. The main latches may then be either manually operated or operated by solenoids connected to control circuitry to release the toggle lever so that the spring will react against the toggle lever to either open or close the switch depending on the position of the switch at the initiation of operation. Once the switch has either opened or closed, the spring may be either recharged automatically by the motor, or if manual operation is desired, the motor can be disabled so that the spring can be biased by manual rotation of the drive lever. A clutch mechanism is provided to disconnect the motor from the mechanism when a manual tool is inserted into the mechanism. Also provided is a shutter bolt that locks out automatic operation of the main latches when the manual tool is inserted, electrically disconnects the motor, and prevents manual operation of the main latches when the tool is inserted into the mechanism. Also, if it is desirable to test the solenoids without tripping the main latches, a mechanism is provided to manually disconnect solenoids from the main latches. In addition, in case the switch blade is welded or stuck in the closed position, an automatic pry-out mechanism is provided to assure contact separation during switch opening.

20 Claims, 21 Drawing Figures

10
12
14
16
18
20
22
24
26
28
30
32
34
36
38
38'
40
42
44
46
48
50
88
9
270
72
2

18
20
16
32
3
52
54
56
58
60
62
64
64'
46'
270
210
236

130
176
166
400
120
76
24
74
70
254
258
210
244
11
240
260
248
242
246
250
244
24
256
80
408
406
252
254
248
250
260

234
230
232
196
208
164
218
220
236
202
216
214
198
194
212
226
206
200
222
224
130
210

234
230
196
208
164
218
236
202
206
214
198
226
212
216
130
222
210
224

SPIRAL OPERATING MECHANISM FOR HIGH VOLTAGE SWITCH

BACKGROUND OF THE INVENTION

1. Field of the Invention

The present invention relates to mechanisms for operating high voltage switches, and more particularly, to a spiral spring operated mechanism which may be either automatically or manually operated or controlled to both open and close high voltage switches.

2. Description of the Prior Art

The present invention constitutes an improvement over the construction disclosed in U.S. Pat. No. 3,563,102 — Bernatt, et al., entitled "SPIRAL SPRING OPERATING MECHANISM FOR HIGH VOLTAGE SWITCH", issued on Feb. 16, 1971, and assigned to the same assignee as the present invention. That patent discloses a manually operable spiral spring mechanism for opening and closing high voltage switches. However, the mechanism disclosed in that patent may only be manually operated and no provision is made in the structure disclosed in that patent for automatic operation. In many high voltage installations, it is desirable to provide a switch operating mechanism which can be remotely controlled and operated without the necessity of human operation. However, in many situations, manual operation is also desirable so that it would be advantageous to provide a switch operating mechanism that may be operated either automatically or manually depending upon the desired function.

Thus, it would be a desirable advance in the art to provide a switch operating mechanism which may either be automatically controlled and operated or manually controlled and operated depending upon the desire function.

BRIEF DESCRIPTION OF THE INVENTION

An improved mechanism for operating a switch between opened and closed and between closed and opened positions in accordance with the present invention comprises a pivotably mounted toggle lever operably connected to the switch. Pivotably mounted about the same axis as the toggle lever is a drive lever. A spiral spring is coaxially positioned with respect to the drive and toggle levers and interconnects the drive and toggle levers. First and second main latch means are provided for releasably holding the toggle lever in the switch-closed and switch-opened positions respectively. A biasing means is provided connected to the drive lever for pivoting the drive lever in a first direction to bias the spring for switch opening and in a second direction for biasing the spring for switch closing. A first stop latch is provided for engaging and holding the drive lever in a spring-biased position ready for switch opening when the biasing means pivots the drive lever in the first direction. A second stop latch means is provided for engaging and holding the drive lever in a spring-biased position for switch closing when the biasing means pivots the drive lever in the second direction. Connected to the first main latch means is a first operator means for causing the first latch means to release the toggle lever so that the toggle lever will pivot under the biasing of the spring to open the switch. Connected to the second main latch means is a second operator means for causing the second latch means to release the toggle lever so that the toggle lever will pivot under the biasing of the spiral spring to close the switch.

The biasing means may comprise an electric motor that is automatically controlled depending upon the positional relationship of the drive lever and the switch to either bias the spring ready for switch opening or switch closing as required. Alternatively, the biasing means may comprise a hand-operated crank tool which may be inserted into the mechanism and cranked to manually bias the spring in the desired direction.

The first and second operator means may comprise either solenoids operably connected to the first and second main latches respectively, for causing these latches to release the toggle lever in response to electrical control signals. Alternatively, the operator means may also comprise hand-operated levers operably connected to the first and second main latches which will cause these latches to release the toggle lever in response to hand operation.

Since the improved mechanism in accordance with the present invention is designed primarily for automatic operation, to assure switch opening even in instances where the switch blades are welded or stuck in the closed position, an automatic pry-out means is provided providing additional force to the toggle lever to open the switch if the spring biasing forces are insufficient to open the switch.

In addition, since both automatic and manual operations may take place, it is desirable to provide interfacing logic to preclude manual operation when automatic operation is desired and vice versa. Accordingly, a shutter bolt is provided which prevents the hard-operated crank tool from being inserted into the mechanism when automatic operation is desired. However, the shutter bolt may be moved to allow insertion of the tool and movement of the shutter bolt will electically disconnect the motor and the solenoids so that the mechanism cannot be operated automatically. In addition, a clutch mechanism is provided so that when the tool is inserted into the mechanism, the motor is mechanically disconnected from the mechanism as well. Also, since operation of the main latches to either open or close the switches while the manual tool is inserted in the mechanism could result in injury to an operator or damage to the equipment, the shutter bolt prevents manual tripping of the main latches while the tool is inserted into the mechanism. Thus, neither automatic nor manual release of the toggle lever can occur while the tool is inserted into the mechanism.

While the present invention relates to an automatic system which can be automatically operated to both open and close the switches under remote automatic control, by slight variations, the present invention may provide for automatic opening of the switch blade but manual closing and recharging of the spring. Similarly, the present invention may provide for automatic closing of the switch blade with manual opening and recharging of the spring if the particular facilities require such manual checkout after switch operation.

Thus, it is a primary feature of the present invention to provide a spiral spring operating mechanism for high voltage switches which provides for indefinite storage of spring energy for operation which may be released remotely by automatic control or by local manual control when required to operate a high voltage switch.

It is yet a further object of the present invention to provide a spiral spring operating mechanism for high voltage switches which utilizes a motor to supply the energy to the spring to cause the spring to store energy so the mechanism may be operated to utilize the spring energy to move the blades of a high voltage switch at a predetermined speed.

It is yet another object of the present invention to provide a spiral spring operating mechanism for high voltage switches that may be either automatically operated by an electrical solenoid arrangement or may be manually operated and which also provides means for allowing the solenoid to be tested without operating the main latches of the mechanism.

It is yet another object of the present invention to provide a spiral spring operating mechanism for high voltage switches that may be manually cocked and tripped in one direction and manually cocked in the other direction ready for automatic tripping to provide for immediate or delayed operation of a high voltage switch.

It is yet another object of the present invention to provide a spiral spring operating mechanism for high voltage switches which includes a shutter bolt system for providing electro-mechanical interlocks between the manual operation and the automatic operation.

It is yet a further object of the present invention to provide a shutter bolt system that automatically prevents manual tripping of the mechanism when the manual crank tool is inserted into the mechanism.

It is yet a further object of the present invention to provide a clutch mechanism which disconnects the motor from the mechanism when the hand tool is inserted into the mechanism.

Yet another object of the present invention is to provide an automatic pry-out means that can provide additional energy if the high voltage switch blades are stuck or welded in the closed position and the energy available from the spiral spring is insufficient to open the switch blades.

These and other objects, advantages, and features will hereinafter appear, and for the purposes of illustration, but not of limitation, exemplary embodiments of the present invention are illustrated in the accompanying drawings.

DETAILED DESCRIPTION OF THE PREFERRED EMBODIMENTS

Figure 1:
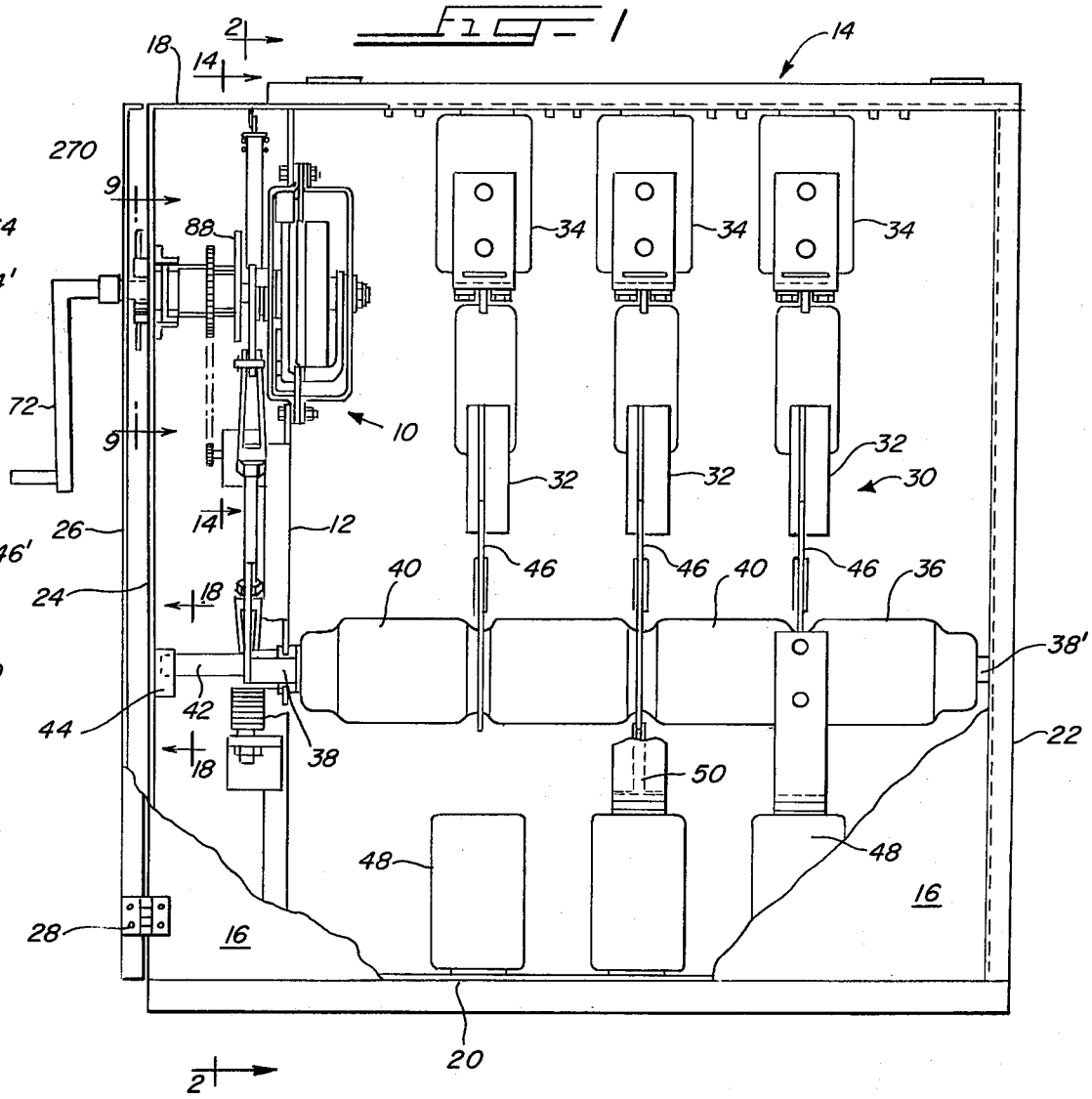
FIG. 1 is a side partially fragmentary elevational view of the preferred embodiment of the present invention showing the high voltage switches operated by the mechanism.

FIG. 1 is a side elevational view of a three-phase switch module provided with a spiral spring operation mechanism in accordance with the present invention. Mechanism 10 is mounted on wall 12 positioned within metallic housing 14 of the three-phase switch module. Metallic housing 14 comprises side walls 16, top wall 18, bottom wall 20, back wall 22, front panel 24, and front door 26 that is hinge mounted by hinges 28 to side wall 16. Front door 26 may be opened and pivoted on hinges 26 to permit acess to front panel 24.

Mounted within metallic housing 14 is a conventional three-phase switch assembly 30 which comprises stationary contacts 32 mounted by insulators 34 to the top wall 18 of metallic housing 14. Stationary contacts 32 are electrically connected to one side of an electrical circuit. Pivotably mounted to back wall 22 and wall 12 is switch blade assembly 36. Switch blade assembly 36 comprises shafts 38 and 38' mounted in and extending from each end of insulator 40. Mounted on the end of shaft 38 is a cam extension 42 that engages switch blade position sensing switch 44, the purpose of which will be discussed in more detail below.

Mounted on insulator 40 are three switch blades 46 which pivot with shafts 38 and 38' to engage stationary contacts 32. Mounted on each insulator 48 mounted on bottom wall 29 are switch blade contacts 50 which slidably engage each of switch blades 46 to provide continuous electrical connection to the switch blades 46. Switch blade contacts 50 are electrically connected to the other side of an electrical circuit.

Figure 2:
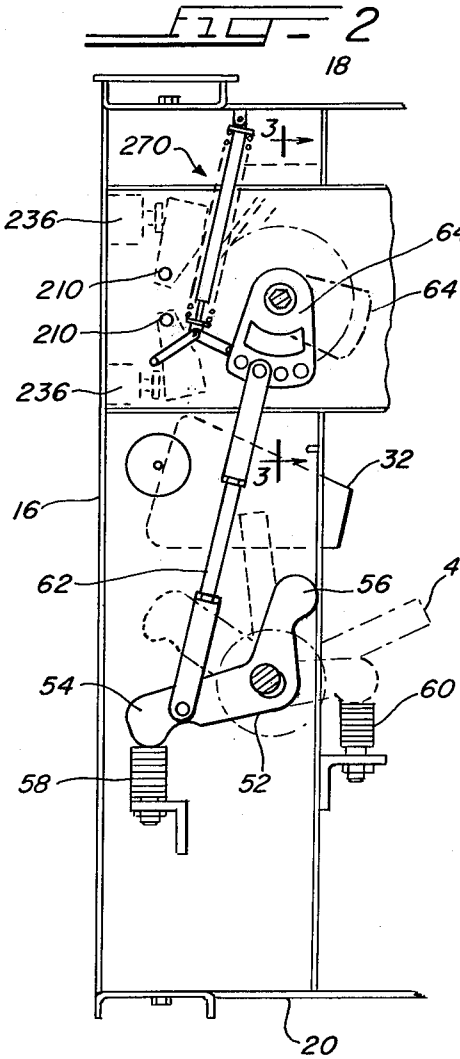
FIG. 2 is a cross sectional partially fragmentary view taken substantially along line 2—2 in FIG. 1.

Ridiidly attached to one end of shaft 38 is a lever 52 having arms 54 and 56 that engage stops 58 and 60 respectively when switch blade assembly 36 is pivoted between the switch-closed and the switch-opened positions. In FIG. 2, lever 52 is shown in the switch-closed position with arm 54 engaging stop 58. However, when lever 52 is pivoted to the position shown in the dotted lines so that arm 56 engages stop 60, the switch blade 46 is moved to the position illustrated by the dotted lines designated 46′ thereby disengaging stationary contacts 32 and opening the circuit.

Pivotably connected to arm 54 of lever 52 is one end of linkage member 62. The other end of linkage member 62 is pivotably connected to switch lever 64. The rotation of switch lever 64 to the position illustrated by the dotted lines and designated 64′ in FIG. 2 causes lever 52 to pivot to the switch-opened position as illustrated by the dotted lines.

Figure 3A:
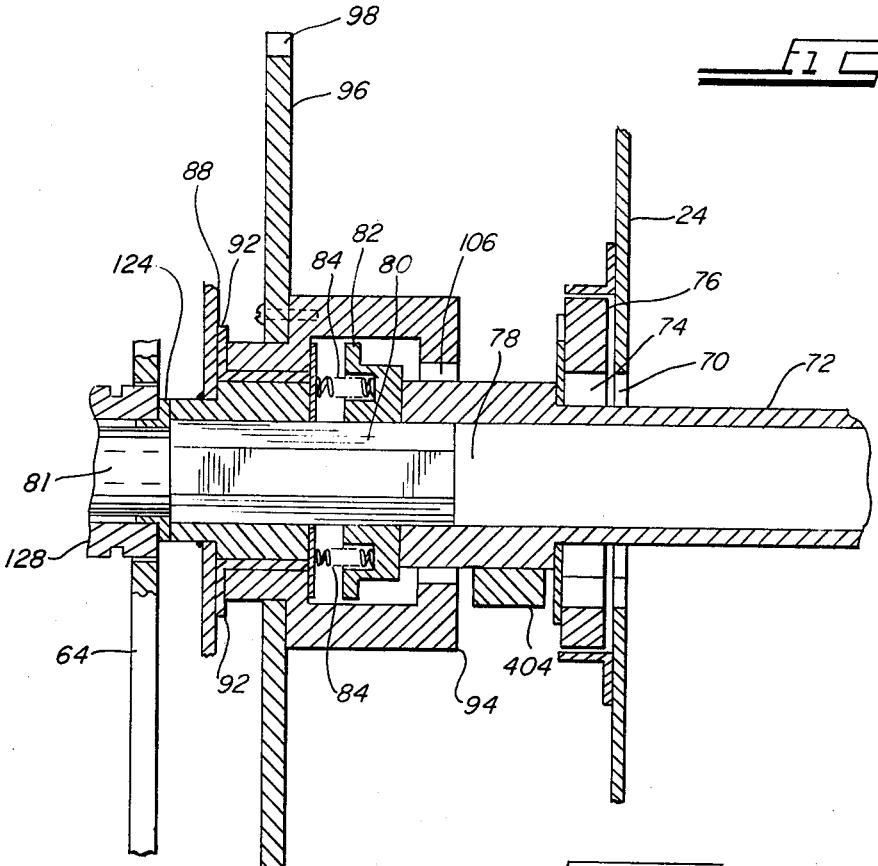
FIG. 3A is a cross sectional partially fragmentary view of the clutch mechanism of the present invention taken in the direction of line 3—3 in FIG. 2.
Figure 3B:
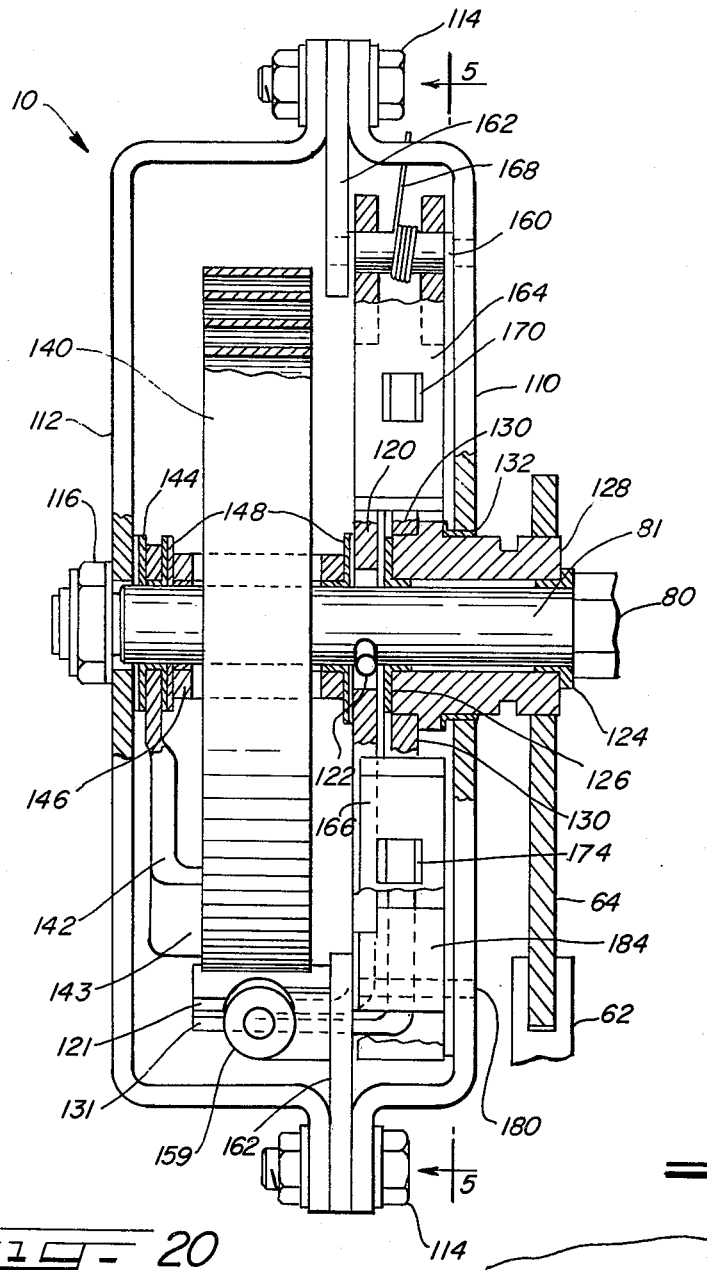
FIG. 3B is a cross sectional partially fragmentary view of the spiral spring mechanism of the present invention taken in the direction of line 3—3 in FIG. 2.

With reference to FIGS. 3A and 3B, these figures illustrate a cross sectional view of the spiral spring mechanism 10 and clutch mechanism when viewed in the direction of line 3—3 in FIG. 2. With reference to FIG. 3A, front panel 24 has an opening 70 through which a hand crank tool 72 may be inserted when opening 74 in shutter bolt 76 is properly aligned as will be more fully described hereinafter. Hand crank tool 72 has a hollow interior 78 at the end thereof that has a hexagonal cross section dimensioned to engage the hexagonal end of shaft 80 so that when hand crank tool 72 is rotated, shaft 80 will also be rotated.

Shaft 80 also extends through a mating hexagonal opening in clutch block 82 so that clutch block 82 rotates with shaft 80. Clutch block 82 is dimensioned to slide along shaft 80 and springs 84 are provided to normally bias clutch block 82 to the right as viewed in FIG. 3A. Also positioned around shaft 80 is a sleeve 86 that extends through contact plate 88 and rotates with shaft 80. Mounted on shaft 80 on sleeve 86 so that it rotates with shaft 80 is motor switch contact plate 88. The purpose of motor switch contact plate 88 will be more fully described below. Positioned around sleeve 86 is annular bearing 92, and riding on bearing 92 is clutch housing 94. Rigidly mounted on clutch housing 94 is motor sprocket 96 that has teeth 98 around the periphery thereof for engaging a chain 100 (shown in dotted lines) that also engages a sprocket 102 mounted on the shaft of a motor 104. Thus, operation of motor 104 causes motor sprocket 96 and clutch housing 94 to rotate.

Figure 4:
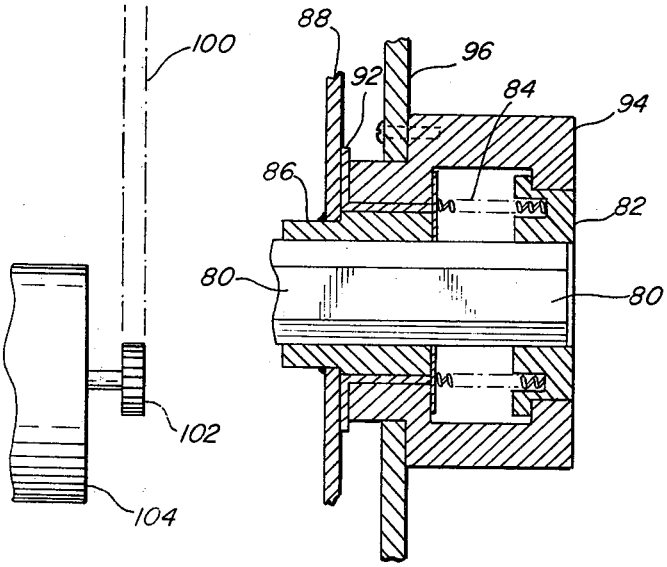
FIG. 4 is a cross sectional partially fragmentary view of the clutch mechanism illustrated in FIG. 3A showing the clutch block in the engage position.

Clutch housing 94 has a hexagonal shaped opening 106 formed through one side thereof which is dimensioned to engage the hexagonal cross section of clutch block 82 when clutch block 82 is moved to the position illustrated in FIG. 4 after tool 72 has been removed. However, when tool 72 is inserted as illustrated in FIG. 3A, clutch block 82 is moved to the left as viewed in FIG. 3A so that the hexagonal cross section of clutch block 82 disengages the hexagonal opening 106 in clutch housing 94. In this position if tool 72 is pivoted, shaft 80 may be rotated but motor sprocket 96 and clutch housing 94 will not rotate so there will be no interference with hand operation. When clutch block 82 is in the position illustrated in FIG. 4, and motor 104 is energized, sprocket 96 and housing 94 are rotated, and since these members are directly connected through clutch block 82 to shaft 80, shaft 80 is also rotated.

With reference to FIG. 3B, the end of shaft 80 shown on the right side of FIG. 3B is connected to the part of shaft 80 on the left side of FIG. 3A. Shaft 80 has a circular cross sectional area 81 which extends through front mechanism wall 110 and rear mechanism wall 112. Front and rear mechanism walls 110 and 112 are joined by bolts 114 and shaft 80 is held in position by nut 116 which is thread mounted to the end of shaft 80.

Mounted on circular section 81 of shaft 80 inside the mechanism housing is drive lever 120. Drive lever 120 is pinned to shaft 80 by pin 122 so that drive lever 120 rotates when shaft 80 rotates. Positioned around circular section 81 of shaft 80 are annular bearings 124 and 126 and riding on annular bearings 124 and 126 is toggle lever sleeve 128. Also positioned in a circular opening in front mechanism wall 110 around toggle lever sleeve 128 is bearing bushing 132. Thus, toggle lever sleeve 128 can freely rotate with respect to front mechanism wall 110, and also rotate independently of shaft 80. Rigidly mounted on one end of toggle lever sleeve 128 is toggle lever 130, and mounted on the other end of toggle lever sleeve 128 is switch lever 64. Both switch lever 64 and toggle lever 130 are journalled on toggle lever sleeve 128 so that toggle 130, toggle lever sleeve 128 and switch lever 64 are rigidly joined and rotate as a unit. Pivotably connected to the end of switch lever 64 is linkage member 62 as previously described.

Also positioned around the circular section 81 of shaft 80 is spiral spring 140. One end of spiral spring 140 is connected to first spring arbor 142 which is pivotably mounted on circular section 81 of shaft 80 by bearing 144 so that first spring arbor can freely rotate about shaft 80. The other end of spiral spring 140 is connected to second spring arbor 146 which is also pivotably mounted on circular section 81 of shaft 80 by bearings 148 so that it will freely rotate around shaft 80.

Figure 5:
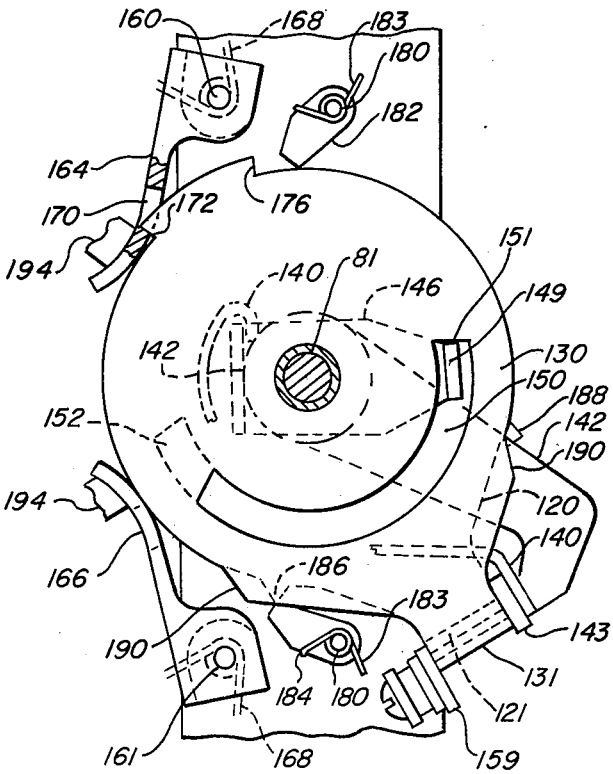
FIG. 5 is a cross sectional partially fragmentary view taken substantially along line 5—5 in FIG. 3B showing the toggle lever and the drive lever in the switch-closed spring-unbiased position.

With reference to FIGS. 3B and 5, first spring arbor 142 has a curved end 143 that engages a tang 131 on toggle lever 130 and a tang 121 on drive lever 120. Second spring arbor 146 (illustrated in dotted lines in FIG. 5) has formed at one end thereof a flange 147 to which spring 140 is connected and a tang 149 formed at the other end thereof which extends through a slot 150 in toggle lever 130 and a slot 152 in drive lever 120. In FIG. 5, drive lever 120 is positioned behind toggle lever 130 and is thus illustrated in dotted lines except where portions extend beyond the edge of toggle lever 130. In addition, in FIG. 5, slots 150 and 152 coincide except at one end thereof slot 152 extends beyond slot 150 and is shown in dotted lines. In the position illustrated in FIG. 5, tangs 131 and 121 are held against stop 159 by first spring arbor 142.

Pivotably mounted by pins 160 and 161 extending through front mechanism wall 110 and support 162 are first and second main latches 164 and 166. First and second main latches 164 and 166 are spring biased by springs 168 so that they are biased to engage toggle lever 130. First main latch 164 has an opening 170 formed therein that is dimensioned to engage an engaging surface 172 formed on toggle lever 130. Similarly, second main latch 166 has a opening 174 formed therethrough dimensioned to engage engaging surface 176 on toggle lever 130 when tottle lever 130 is pivoted to the position illustrated in FIGS. 7 and 8.

Pivotably mounted by pins 180 extending through front mechanism wall 110 and supports 162 are first stop latch 182 and second stop latch 184. First and second stop latches 182 and 184 are wide enough to engage both drive lever 120 and toggle lever 130 and are spring biased by springs 183 to constantly pivot towards these levers.

Drive lever 120 has projecting from the periphery thereof engaging surfaces 186 and 188. These surfaces are adapted to engage first and second stop latches 182 and 184 respectively when drive lever 120 is in the position illustrated in FIGS. 6 and 8, respectively. Toggle lever 130 has cam surfaces 190 and 192 formed on the periphery thereof adjacent tang 131. These cam surfaces are dimensioned to engage first and second stop latches 180 and 182 to disengage them from engaging surfaces 186 and 188 when toggle lever 130 is in the positions illustrated in FIGS. 5 and 7, respectively.

Figure 12:
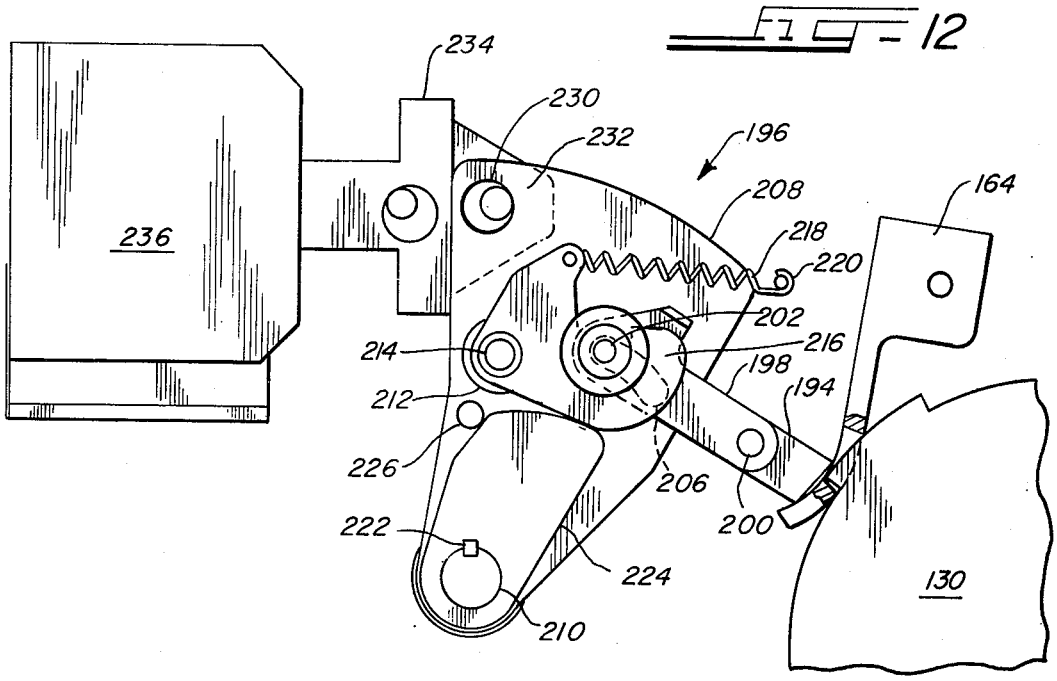
FIGS. 12 and 13 are elevational partially fragmentary views of the solenoid and manual latch operating assembly.
Figure 13:
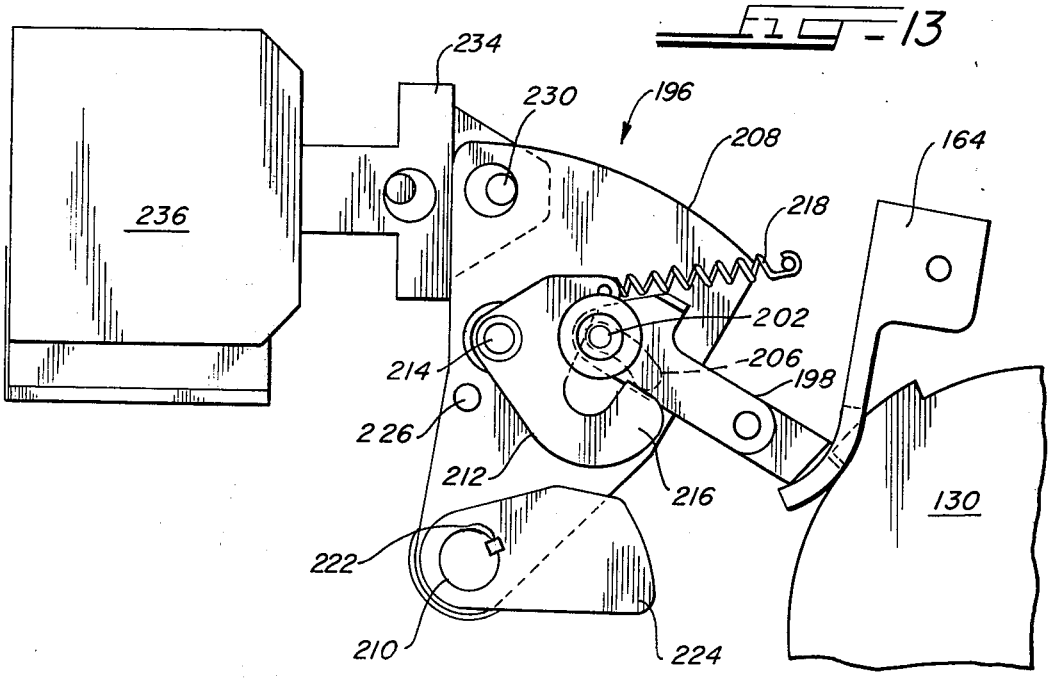

With reference to FIGS. 12 and 13, first and second main latches 164 and 166 have a flange 194 extending therefrom that connects to operating assembly 196. Since operating assembly 196 is identical for both the first and second main latches 164 and 166, only one operating assembly 196 is illustrated. However, it should be understood that an identical but inverted mechanism is also connected to second main latch 166. Flange 196 is pivotably pinned to a link 198 by a pin 200. Mounted to the other end of link 198 is pin 202 that extends through a slot 206 in plate 208. Plate 208 is pivotably mounted around operator shaft 210 and pivots independent of shaft 210. A plate 212 is pivotably mounted on plate 208 by a pin 214, and plate 212 has an engaging arm 216 that engages pin 202 when plate 212 is in the position illustrated in FIG. 12. Plate 212 is connected to spring 218 which is also connected to a stationary shaft 220 rigidly mounted to the mechanism housing so that spring 218 normally biases plate 212 to move in a clockwise direction as illustrated in FIG. 12.

Mounted on operator shaft 210 and keyed to operator shaft 210 by key 222 is cam 224. When cam 224 is in the position illustrated in FIG. 12, cam 224 engages plate 212 moving it so that engaging arm 216 engages pin 202. However, when cam 224 is pivoted to the position illustrated in FIG. 13 when operator shaft 210 is rotated clockwise, plate 212 is pivoted as a result of the biasing of spring 218 so that engaging arm 216 disengages pin 202. Further, when cam 224 is in the position illustrated in FIG. 12, cam 224 engages pin 226 so that if operator shaft 210 is rotated in a counterclockwise direction as viewed in FIG. 12, cam 224 will cause plate 208 to pivot in a counter-clockwise direction around shaft 210.

Extending through an opening 230 in plate 208 is a shaft 232 that is connected to an armature 234 of a solenoid 236. Solenoid 236 is electrically connected to appropriate control circuitry so that when solenoid 236 is energized, armature 234 moves to the left as viewed in FIG. 12 causing plate 208 to pivot around shaft 210 in a counterclockwise direction as viewed in FIG. 12 thereby pivoting first main latch 164 away from toggle lever 130 thereby disengaging first main latch 164 from toggle lever 130. Similarly, if operator shaft 210 is rotated in a counterclockwise direction, cam 224 engages pin 226 causing plate 208 to pivot to cause main latch 164 to disengage toggle lever 130. However, if cam 224 is pivoted to the position illustrated in FIG. 13 so that plate 212 pivots to disengage engaging arm 216 from pin 202, plate 208 can be pivoted so that pin 202 slides in slot 206 but main latch 164 will remain in engagement with toggle lever 130. In this mode, solenoid 236 may be electrically tested without disengaging main latch 164 from toggle lever 130.

With reference to FIG. 2, the position of solenoid 236 is shown in dotted lines. Operator shafts 210 extend through shutter bolt 76 and front panel 24, and mounted on the end of operator shaft 210 are operator levers 240 (see FIGS. 9 and 10). Also mounted on shaft 210 by pin 242 is hub 244 (see FIG. 11). Hub 244 has opposite flat surfaces 246 that are dimensioned to slide in a slot 248 in shutter bolt 76. Formed at the end of slot 248 is an enlarged area 250 that is sufficiently large to allow hub 244 to freely rotate. However, when the opposite surfaces of slot 248 engage the flat surfaces 246 on hub 244, hub 244 and operator shaft 210 cannot be rotated.

Figures 9, 10, 11, 19:
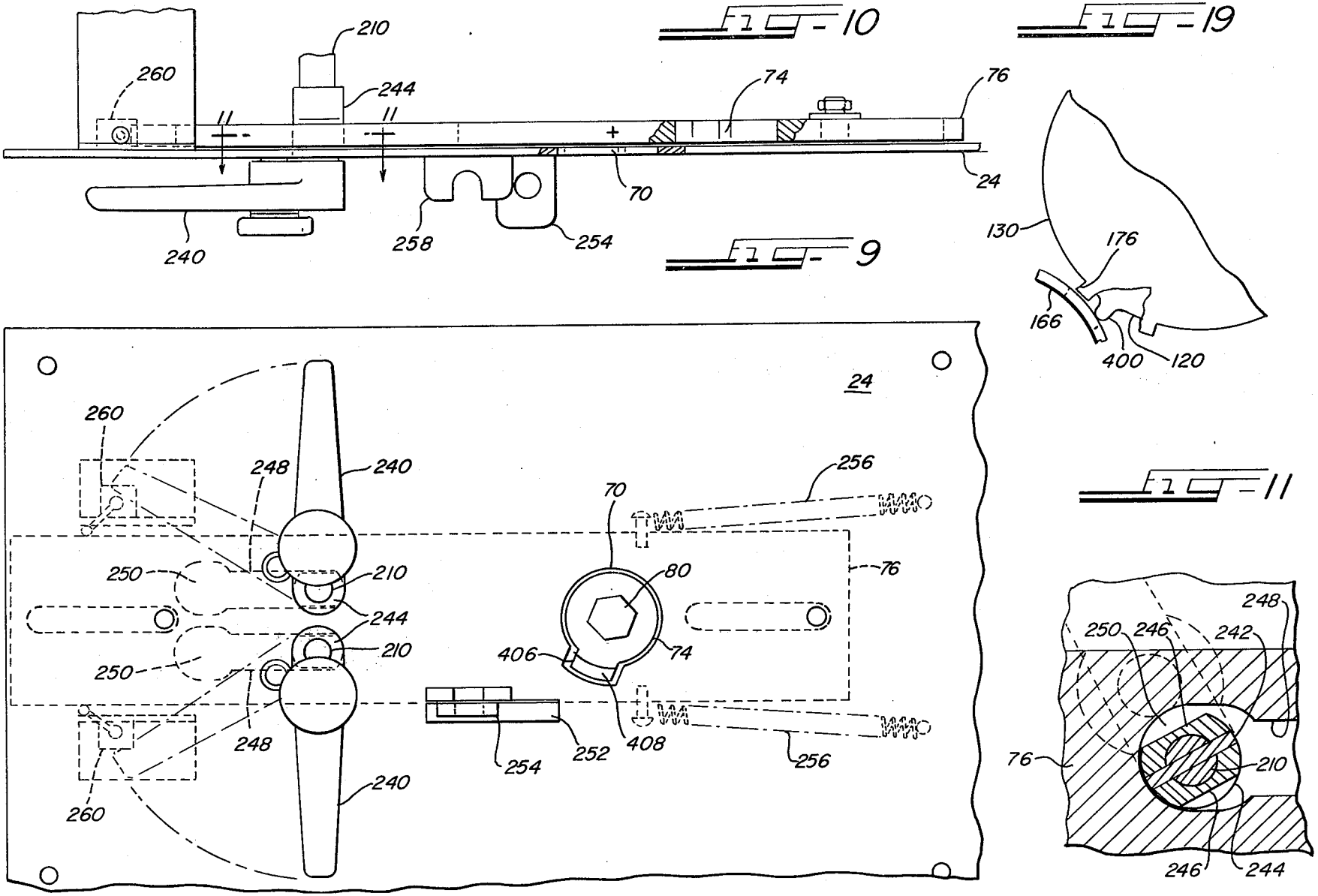
FIG. 9 is a front view of the front panel taken substantially along line 9—9 in FIG. 1 showing the shutter bolt in the open position.
FIG. 10 is a top view of the front panel illustrated in FIG. 9 showing the shutter bolt in the closed position.
FIG. 11 is a cross sectional partially fragmentary view taken substantially along line 11—11 in FIG. 10.

As previously pointed out, there is an opening 70 formed in front panel 24 that aligns with the end of shaft 80. Also, there is an opening 74 formed in shutter bolt 76. In FIG. 10, shutter bolt 76 is shown in the closed position so that openings 70 and 74 do not align. However, in FIG. 9, openings 70 and 74 are shown in the aligned position when shutter bolt 76 is moved to the left. When shutter bolt 76 is in the position illustrated in FIG. 9, the hand crank tool 72 may be inserted through openings 70 and 74 to engage the end of shaft 80. However, when shutter bolt 76 is in the position illustrated in FIG. 10, the openings 70 and 74 do not coincide so the tool 72 cannot be inserted.

Mounted to the bottom of shutter bolt 76 and extending through a slot 252 in front panel 24 is lock hasp 254. Movement of lock hasp 254 to the left as viewed in FIGS. 9 and 10 will move shutter bolt 76 to the left aligning openings 70 and 74. Shutter bolt 76 is normally biased by springs 256 to a closed position to the right so that openings 70 and 74 do not coincide. However, when shutter bolt 76 is moved to the left, a lock may be inserted through hasp 254 and hasp 258 mounted on front panel 24 to hold shutter bolt 76 in the opened position.

Also mounted on the inside of front panel 24 are motor disabling switches 260. Motor disabling switches 260 are positioned to engage shutter bolt 76 when it is moved to the position illustrated in FIG. 9 to electrically disconnect the motor 104 when shutter bolt 76 is in the manual position. Motor disabling switches 260 are also connected to the solenoids 236 so that when the shutter bolt 76 is in the manual position illustrated in FIG. 9, the solenoids are also electrically disconnected so that they cannot be operated to release the toggle lever.

Before shutter bolt 76 can be moved to the position illustrated in FIG. 9, the operator levers 240 must be in the position illustrated by the solid lines in FIG. 9 so that the flat surfaces 246 of hub 244 align with slots 248 in shutter bolt 76. Thus, when shutter bolt 76 is moved to the left to the manual position, shaft 210 is locked so that it cannot rotate. Consequently, first and second main latches 164 and 166 cannot be manually operated by the rotation of levers 240 while the shutter bolt is in the manual position and a tool is inserted over shaft 80. This prevents the possible injury to the operator or damage to the mechanism if the toggle lever was accidentally released.

However, when shutter bolt 76 is moved to the right to the position illustrated in FIG. 10, the motor switches 260 reconnect the electrical motor and solenoids so that they are operable and also moves the enlarged area 250 around hub 244 so that levers 240 may be freely pivoted to either manually operate the first and second main latches 164 as previously described or to move cam 224 to the position where engaging arm 216 on plate 212 disengages pin 202 so that the solenoids 236 may be electrically tested without tripping the mechanism.

Figure 14:
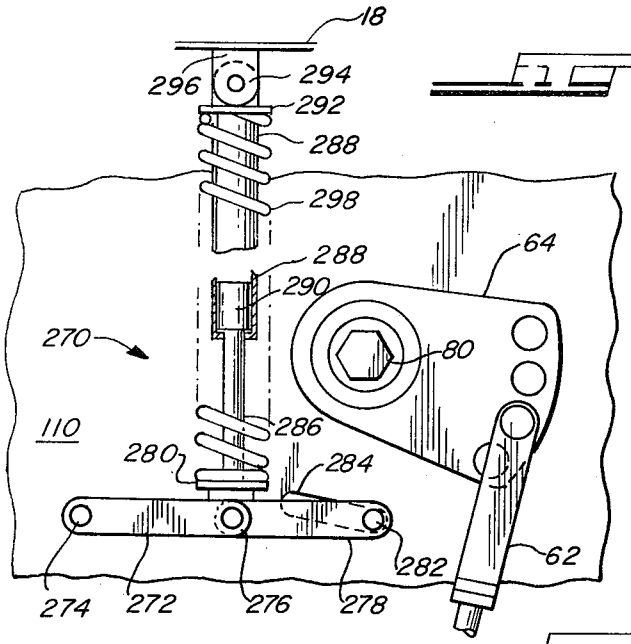

With reference to FIG. 14, the automatic pry-out mechanism 270 is illustrated. Automatic pry-out mechanism 270 comprises first link 272 that is pivotably mounted by shaft 274 to front mechanism housing wall 110. The other end of first link 272 is connected by pin 276 to one end of second link 278 and to spring block 280. Mounted in the other end of spring link 272 is pin 282 which extends outwardly from both sides of second link 272. One end of pin 282 slides in slot 284 in front mechanism housing wall 110, and the other end of pin 282 extends outwardly a sufficient distance to engage the edge of switch lever 64 when switch lever 64 is in the switch-closed position. Mounted on spring block 280 and extending therefrom is a shaft 286 which extends through an opening in the bottom of hollow cylinder 288. Mounted on the end of shaft 286 within the hollow interior of cylinder 288 is a piston 290 which is dimensioned to slide within cylinder 288. Connected to the end of cylinder 288 is spring block 292 that is pivotably connected by a pin 294 to a flange 296 mounted on top wall 18. A coil spring 298 is positioned around cylinder 288 between spring blocks 280 and 292 and normally biases first and second links 272 and 278 to the position illustrated in FIG. 14.

Figure 15:
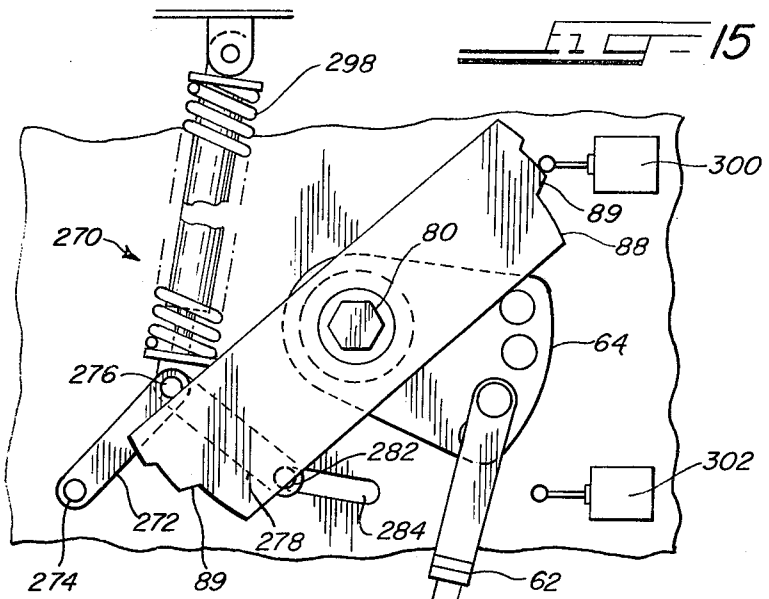
FIGS. 14, 15, 16, and 17 are cross sectional partially fragmentary views taken substantially along line 14—14 in FIG. 1 showing the automatic pry-out mechanism, the switch lever and the motor contact plate in the various positions occurring during operation of the automatic pry-out mechanism.
Figure 17:
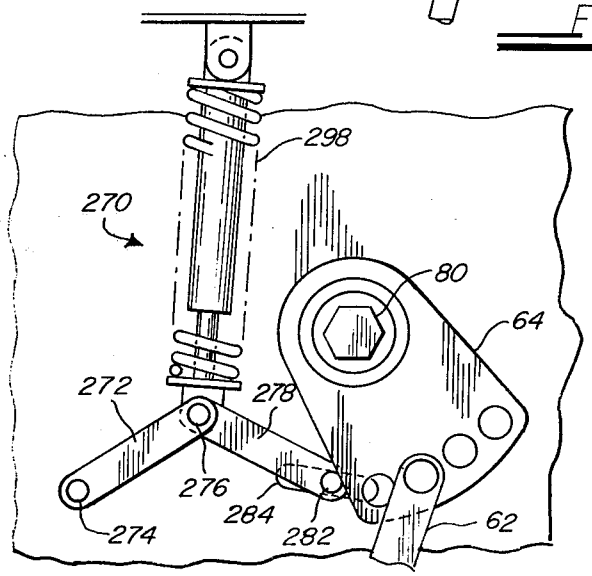

With reference to FIG. 15, motor switch contact plate 88 mounted on shaft 80 is positioned to engage pin 276 when shaft 80 is rotated in a clockwise direction as illustrated in FIG. 15 to cause spring 298 to be compressed as first and second links are pivoted to the position illustrated in FIG. 15. Motor switch contact plate 88 has been deleted from FIGS. 14 and 17 since its presence is not needed to explain those figures. Motor switch contact plate 88 has cam surfaces 89 formed thereon positioned to engage motor limit switches 300 and 302. Motor limit switches 300 and 302 operate to sense the angular orientation of shaft 80 and drive lever 120 and to shut off motor 104 when the drive lever 120 is pivoted to the proper position to bias the spiral spring as will hereinafter be more fully described.

Figure 18:
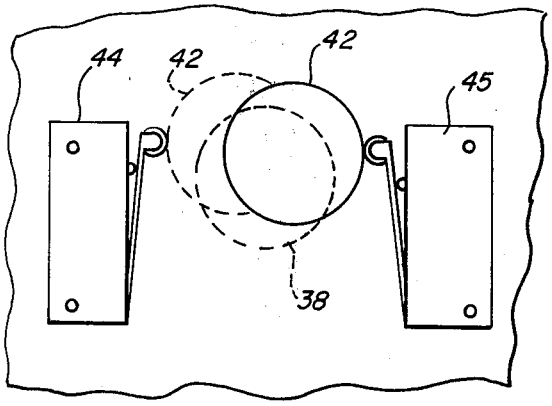
FIG. 18 is a cross sectional partially fragmentary view taken substantially along line 18—18 in FIG. 1 showing the swiches for sensing the position of the switch blade.

With reference to FIG. 18, the switch blade position sensing switches 44 and 45 are illustrated. As previously mentioned, cam extension 42 is mounted on the end of shaft 38 which rotates when switch blades 46 are pivoted. Cam extension 42 is positioned off center with respect to shaft 38 so that as shaft 38 pivots to pivot switch blade 46, cam extension 42 pivots from the position illustrated in the solid lines in FIG. 18 to the position illustrated by the dotted lines 42' in FIG. 18. When cam extension 42 is in the position illustrated in the solid lines, it engages the operating arm of switch 45 causing switch 45 to operate to indicate that the switch blades 46 are in the switch-closed position. When cam extension 42 pivots to the position illustrated by the dotted lines 42' in FIG. 18, it engages the operating arm of switch 44 causing switch 44 to operate to indicate that the switch blades are in the switch-closed position.

Figure 6:
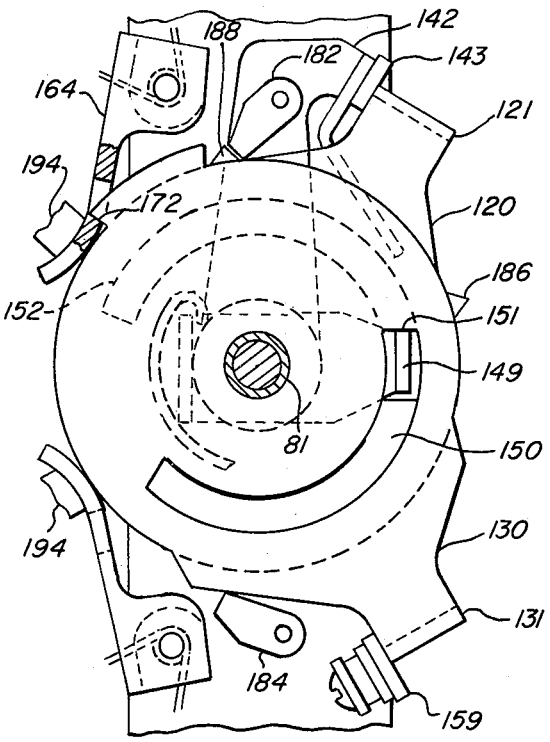
FIG. 6 is a view corresponding to FIG. 5 except showing the drive lever in the spring-charged position ready for switch opening.

Operation of the present invention will be initially described with respect to the automatic mode of operation. In this condition, tool 72 cannot engage shaft 80 because shutter bolt 76 is in the position illustrated in FIG. 10, and clutch block 82 is engaging clutch housing 94 as illustrated in FIG. 4. With reference to FIG. 5, the toggle 130 and the drive lever 120 are illustrated in the switch-closed spring-unbiased position. In this position, switch blade position sensing switch 45 would indicate that the switch blade is closed, however, motor switch contact plate 88 is in the position illustrated in FIG. 15 so that the motor switch 302 is not engaged. Thus, this positional relationship would cause appropriate control circuitry to energize motor 104 so that it pivots sprocket 96 and connected shaft 80 in a counterclockwise direction as viewed in FIGS. 5 and 6. The rotation of shaft 80 in a counterclockwise direction would cause dirve lever 120 to also rotate in a counterclockwise direction so that tang 121 engages first spring arbor 142 pivoting first spring arbor 142 in a counterclockwise direction. However, since first main latch 164 is engaging surface 172 on toggle lever 130, toggle lever 130 cannot rotate, and the upper edge 151 of slot 150 in toggle lever 130 engages tank 149 on second spring arbor 146 holding second spring arbor 146 in the position illustrated in FIG. 5. tang As first spring arbor 142 pivots in a clockwise direction, spring 140 is thus wound and unbiased. Drive lever 120 continues to pivot until it reaches the position illustrated in FIG. 6 so that first stop latch 82 engages engaging surface 188 on drive lever 120. At this point, motor switch contact plate 88 has pivoted as motor 104 rotates shaft 80 to the position illustrated in FIG. 16 so that it engages switch 302 thereby causing motor 104 to be de-energized. However, since first stop latch 182 is engaging surface 188, drive lever 120 is held in the spring-charged position as illustrated in FIG. 6. The spring energy can be held indefinitely until solenoid 236 is operated and first main latch 164 is pivoted to disengage engaging surface 172 on toggle lever 130. When toggle lever 130 is so released, toggle lever 130 pivots in a counterclockwise direction as tang 149 presses against the end 151 of slot 150 until toggle lever 130 reaches the position illustrated in FIG. 7 with tang 131 against the curved end 143 of first spring arbor 142. When toggle lever 130 pivots to this position, cam surface 192 engages first stop latch 182 pivoting it away from engaging surface 188 on drive lever 120 so that drive lever 120 may be pivoted back in the opposite direction to bias the spring in the opposite direction ready for switch closing.

Figure 7:
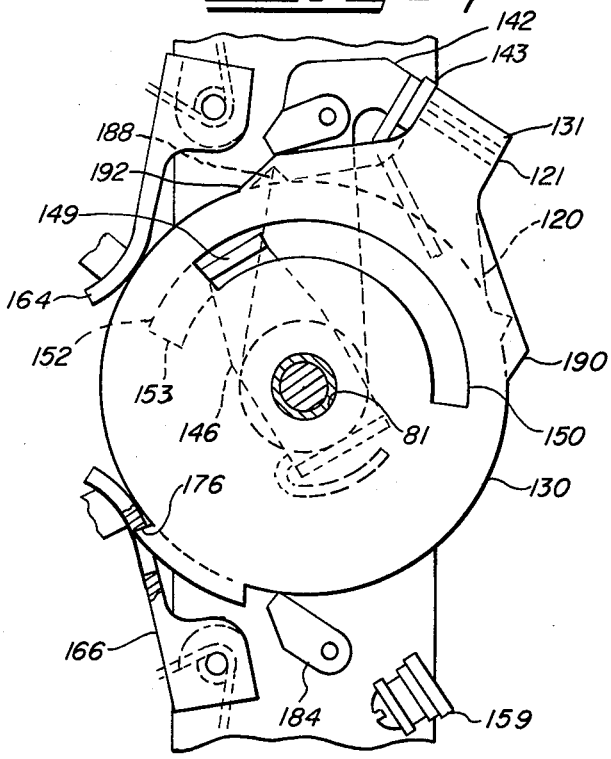
FIG. 7 is a view corresponding to FIG. 5 except showing the toggle lever and the drive lever in the switch-opened spring-unbiased position.
Figure 8:
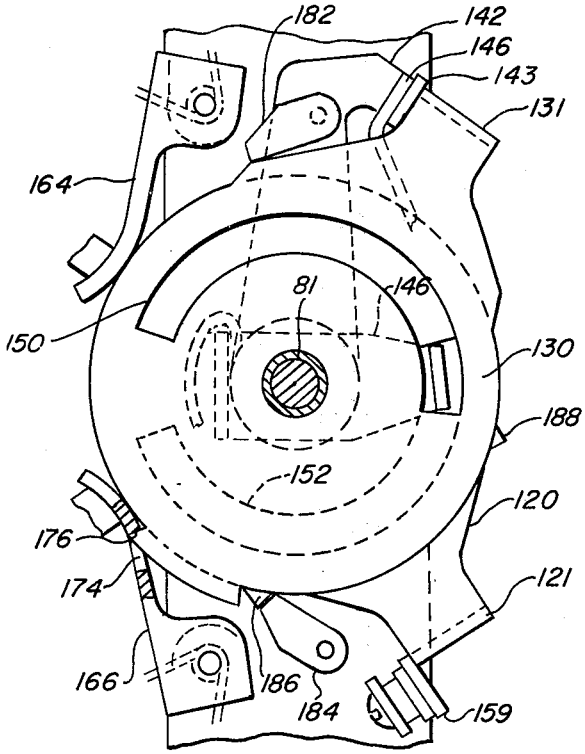
FIG. 8 is a view corresponding to FIG. 5 except showing the toggle lever in the switch-opened position and the drive lever in the spring-unbiased position ready for switch closing.

When toggle lever 130 pivots to the position illustrated in FIG. 7, this rotation causes toggle lever sleeve 128 to rotate switch lever 64 very rapidly to the position illustrated by the dotted lines and designated 64' in FIG. 2 thereby causing switch blade 46 to rapidly pivot to the open position designated 46' in FIG. 2. This rotation of the switch blade caused cam extension 42 to pivot to the position illustrated in the dotted lines 42' in FIG. 18 thereby engaging switch 44 to indicate the switch-opened position. Also, motor switch contact plate 88 is in the position illustrated in FIG. 16 so that switch 300 is not engaged. This positional relationship would cause appropriate control circuitry, to energize motor 104 in a reverse direction to pivot shaft 80 in a clockwise direction as illustrated in FIGS. 7 and 8. The rotation of shaft 80 causes drive lever 120 to rotate in a clockwise direction until the end 153 of slot 152 engages tang 149 on second spring arbor 146 causing spring arbor to pivot in a clockwise direction as illustrated in FIG. 7. However, since second main latch 166 engages surface 176 on toggle plate 130, tank 131 holds first spring arbor 142 in the position illustrated in FIG. 7 so that it cannot pivot. Thus, as drive lever 120 pivots to the position illustrated in FIG. 8, spring arbor 146 is also pivoted to the position illustrated in FIG. 8 thereby biasing spring 140 in the opposite direction ready for spring closing. When drive lever 120 reaches the position illustrated in FIG. 8, second stop latch 184 engages engaging surface 186 thereby holding the drive lever 120 in the spring-charged position.

To close the switch blade, solenoid 236 is operated to pivot second main latch 166 away from surface 176 so that toggle lever 130 is released to pivot under the spring biasing of spring 146 against first spring arbor 142 and tang 131 until toggle lever 130 is in the position illustrated in FIG. 5 once again. In this position, cam surface 190 on toggle lever 130 pivots second main latch 184 away from engaging surface 186 so that the drive lever is ready to be pivoted back the opposite direction to recharge the spring ready for switch opening as previously described.

The rapid pivoting of toggle lever 130 from the position illustrated in FIG. 8 to the position illustrated in FIG. 5 causes switch lever 64 to rapidly pivot back to the position illustrated in solid lines in FIG. 2 thereby causing the switch blades 46 to pivot back into engagement with the stationary contacts 32.

Figure 16:
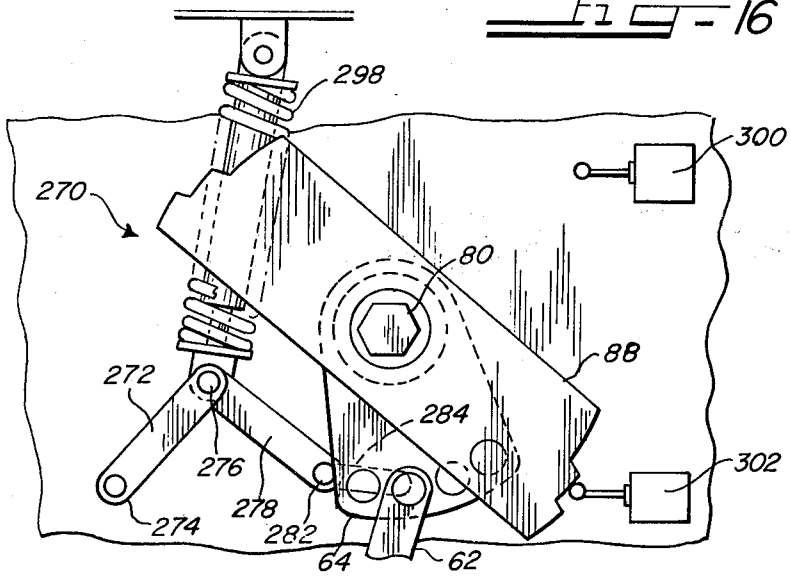

To assist in the opening of switch blade 46 from stationary contact 32 in case the switch blades are welded to contacts 32 or otherwise stuck, automatic pry-out mechanism 270 is also provided. This mechanism is automatically cocked when the spiral spring 140 is recharged for switch closing. In particular, with reference to FIG. 14, switch lever 64 is shown in the switch-opened position and the automatic pry-out mechanism 270 is shown in the uncocked position. When shaft 80 rotates to bias spring 140 ready for switch closing, as previously described, shaft 80 rotates in a clockwise direction as illustrated in FIG. 14 causing switch contact plate 88 to pivot from the position illustrated in FIG. 16 to the position illustrated in FIG. 15 so that the edge of plate 88 engages pin 76 causing first and second links 272 and 278 to pivot to the position illustrated in FIG. 15 thereby compressing spring 298. When the mechanism is operated to close the switch blade 46 into stationary contacts 32, switch lever 64 is rapidly pivoted from the position illustrated in FIG. 15 to the position illustrated in FIG. 16 so that the edge of lever 64 engages pin 282 thereby holding the automatic pry-out mechanism 270 in the cocked position as illustrated in FIG. 16. Contact plate 88 is then pivoted counterclockwise to the position illustrated in FIG. 16 as the spring is rewound ready for switch opening so that contact plate 88 will not be in position to engage pin 276. When the mechanism is operated and toggle lever 130 is released as previously described to cause switch lever 64 to pivot towards the open position, spring 298 expands causing pin 282 to slide in slot 284 to follow switch lever 64. If the switch blades 46 are either stuck or welded into stationary contacts 32, the switch lever 64 will pivot far enough to take up all slack in the connecting linkage which is roughly the position illustrated in FIG. 17. If the spring force provided by spring 140 is insufficient to break the contacts free, spring 298 will cause pin 282 to exert additional force against the edge of switch lever 64. This force should be sufficient to break the contacts loose since first and second links 272 and 278 operate as a compound lever to substantially multiply the force exerted by spring 298. If the switch blades are not welded or stuck, then spring lever 64 pivots very rapidly to the position illustrated in FIG. 14 and pin 282 is stopped at the end of slot 284 in a position illustrated in FIG. 14.

If it is desired to manually bias spring 140 rather than automatically recharge spring 40 with motor, 104, shutter bolt 76 is moved to the position illustrated in FIG. 9. Openings 70 and 74 align and tool 72 can be inserted through these openings to engage the end of shaft 80. The movement of shutter bolts 86 to the position illustrated in FIG. 9 causes switches 260 to electrically disable motor 104 and also electrically disable solenoids 236. Tool 72 can then be hand cranked to pivot shaft 80 to bias spiral spring 140 as previously described with respect to FIGS. 5, 6, 7, and 8. However, before the toggle lever 130 can be manually released to pivot the switch blade from an open to a closed or from a closed to an open position, the tool 72 must be removed from the housing and shutter bolt 76 must be moved back to the position illustrated in FIG. 10 so that enlarged portion 250 of slot 248 is positioned around hub 244 so that levers 240 can be pivoted. The pivoting of levers 240 causes operator shaft 210 to pivot as previously described with respect to FIG. 12 causing first main latch 164 and second main latch 166 to disengage toggle lever 130 as previously described thereby releasing toggle lever 130 so that it will pivot either to open or close switch blade 46. However, if it is desired to test solenoid 236 without releasing toggle lever 130, levers 240 are pivoted until cam plate 224 is in the position illustrated in FIG. 13 so that engaging arm 216 on plate 212 disengages pin 202. The solenoid 236 may then be operated without causing first main latch 164 to disengage toggle lever 130.

It should be expressly understood that various modifications may be made in the structure and function of the present invention without departing from the spirit and scope of the present invention. For example, by minor modification, the embodiment illustrated herein could be modified to provide for automatic release of the stored spring energy in the switch opening direction only. In this arrangement, after the switch is automatically opened by the solenoid, the switch would have to be manually closed and recocked for spring opening. In this arrangement, second stop latch 184 would be eliminated and second main latch 166 would be tripped by an appropriate projecting cam surface on the drive lever when the drive lever is manually pivoted back to the position illustrated in FIG. 8 so that the toggle lever 130 would be released to close the switch. For example, with reference to FIG. 19, a projecting cam surface 400 could be provided on drive lever 120 to cause second main latch 166 to release engaging surface 176 on toggle lever 130 when the drive lever has been pivoted clockwise to the position illustrated in FIG. 8 to close the switch.

Figure 20:
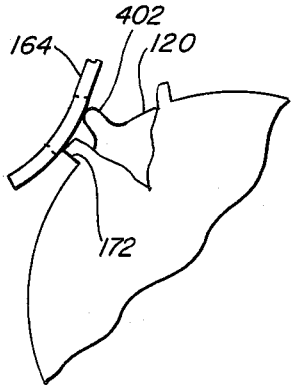
FIGS. 19 and 20 show an alternative embodiment of the drive lever.

Similarly, an alternative arrangement could be provided that would permit automatic operation to release the stored spring energy in the switch closing direction only. In this arrangement, first stop latch 182 would be eliminated and first main latch 164 would be tripped by an appropriate cam surface 402 (see FIG. 20) on the drive lever 120 when the drive lever is manually pivoted to the position illustrated in FIG. 6.

With either of these alternative arrangements, it is necessary to recharge the spring ready for the next operation before the tool is removed since motor 104 is not provided. Accordingly, as a reminder feature tool 72 can be provided with a projection 404 (see FIG. 3A) that is dimensioned to fit through slot 406 in front panel 24 and slot 408 in shutter bolt 76. However, when the tool is cranked to operate the mechanism (either to open or to close the switch depending on which arrangement is used), the projection 404 will not align with slots 406 and 408 until the tool is cranked back to the opposite direction to bias the spring ready for the next automatic operation. Thus, the operator is always reminded to leave the mechanism in a spring-stored energy condition ready for automatic release of the toggle lever since the tool cannot be removed and the door cannot be closed until he does so.

It should be apparent that various changes and modifications may be made to the structure as illustrated herein without departing from the spirit and scope of the present invention as defined in the appended claims.

I claim:

1. An improved mechanism for operating a switch from opened to closed, and from closed to opened positions comprising:

a pivotably mounted toggle lever operably connected to the switch;

a pivotably mounted drive lever pivoted about the same axis as said toggle lever;

spring means coaxial with an interconnecting said toggle and said drive levers;

first main latch means for releasably holding said toggle lever in the switch-closed position;

second main latch means for releasably holding said toggle lever in the switch-opened position;

biasing means connected to said drive lever for pivoting said drive lever in a first direction to bias said spring means for switch opening and in a second direction to bias said spring means for switch closing;

a first stop latch means for engaging and holding said drive lever in a spring biased position for switch opening when said biasing means pivots said drive lever in the first direction;

a second stop latch means for engaging and holding said drive lever in a spring-biased position for switch closing when said biasing means pivots said drive lever in the second direction;

first operator means for causing said first main latch means to release said toggle lever so that said toggle lever will pivot under the biasing of said spring means to open the switch;

second operator means for causing said second latch means to release said toggle lever so that said toggle lever will pivot under the biasing of said spring means to close the switch.

2. An improved mechanism, as claimed in claim 1, wherein said biasing means comprises an electric motor.

3. An improved mechanism, as claimed in claim 1, wherein said biasing means comprises a hand operated crank tool.

4. An improved mechanism, as claimed in claim 1, further comprising automatic pry-out means for providing additional force to said toggle lever to open the switch if said spring means biasing is insufficient to open the switch.

5. An improved mechanism, as claimed in claim 1, wherein:

said first operator means comprises a first solenoid operably connected to said first main latch means that will cause said first main latch to release said toggle lever in response to a first electrical control signal; and said second operator means comprises a second solenoid operably connected to said second main latch means that will cause said second main latch to release said toggle lever in response to a second electrical control signal.

6. An improved mechanism, as claimed in claim 1, wherein:

said first operator means comprises a first hand operated lever operably connected to said first main latch means that will cause said first main latch to release said toggle lever in response to hand operation; and said second operator means comprises a second hand operated lever operably connected to said second main latch means that will cause said second main latch to release said toggle lever in response to hand operation.

7. An improved mechanism, as claimed in claim 5, further comprising:

first disconnecting means for disconnecting said first solenoid from said first main latch means so that said first solenoid may be tested without causing said first main latch to release said toggle lever.

8. An improved mechanism, as claimed in claim 5, further comprising:

second disconnecting means for disconnecting said second solenoid from said second main latch means so that said second solenoid may be tested without causing said second main latch to release said toggle lever.

9. An improved mechanism, as claimed in claim 1, wherein said biasing means may be either automatically pivoted or manually pivoted to bias said spring means, and further comprising a shutter bolt for preventing manual pivoting when automatic pivoting is desired, and for preventing automatic pivoting when manual pivoting is desired.

10. An improved mechanism, as claimed in claim 2, further comprising:

motor limit means for sensing the position of said drive lever; and switch position detecting means for detecting the position of said switch, said motor limit means, and said switch position detecting means operably interconnected to cause said motor to operate to pivot said drive lever in the first direction to bias said spring means ready for switch opening if the switch is closed, and in the second direction to cause said motor to operate to bias said spring means ready for switch opening if the switch is open.

11. An improved mechanism for operating a switch from opened to closed and from closed to opened positions comprising:

a housing;

a shaft mounted for rotation in said housing;

a motor;

a crank tool adapted to engage the shaft, and rotate the shaft in either a first or a second direction;

a clutch means disengageably connecting said motor to said shaft so that said shaft can be rotated in either the first or the second direction by said motor; and so that when said crank tool engages said shaft said clutch means disengages said motor from said shaft;

a drive lever rigidly mounted on said shaft for rotation with said shaft;

a toggle lever mounted for rotation around said shaft;

a switch lever connected to said toggle lever and operably connected to the switch;

a spiral spring interconnecting said drive and toggle levers so that rotation of said drive lever with respect to said toggle lever in the first direction biases said spiral spring for switch opening, and rotation of said drive lever with respect to said toggle lever in the second direction biases said spiral spring for switch closing;

first stop latch means for engaging said drive lever when said drive lever is rotated in the first direction to bias said spiral spring for switch opening;

second stop latch means for engaging said drive lever when said drive lever is rotated in the second direction to bias said spiral spring for switch closing;

first main latch means for releasable holding said toggle lever in the switch closed position;

second main latch means for releasably holding said toggle lever in the switch open positions;

first operator means for causing said first main latch means to release said toggle lever so that said toggle lever and switch lever will pivot under the biasing of said spiral spring to open the switch;

second operator means for causing said first main latch means to release said toggle lever so that said toggle lever and switch lever will pivot under the biasing of said spiral spring to close the switch.

12. An improved mechanism, as claimed in claim 11, wherein said first and second operator means comprises:

solenoid means for releasing said toggle lever in response to a control signal; and manual means for manually releasing said toggle lever in response to manual operation.

13. An improved mechanism, as claimed in claim 12, wherein said solenoid means can be disconnected from said first and second main latch means so that said solenoid means can be tested without releasing said toggle lever means.

14. An improved mechanism, as claimed in claim 11, further comprising automatic pry-out means for engaging said switch lever during switch opening and applying additional force to open the switch if the spiral spring bias forces are insufficient to open the switch.

15. An improved mechanism, as claimed in claim 14, wherein said automatic pry-out means comprises:

a first link pivotably mounted at a first end to said housing;

a second link pivotably mounted at a first end to the second end of said first link;

a pin mounted in the second end of said second link, said pin dimensioned to slide in a slot in said housing and engage said switch lever when said switch lever is in the switch-closed position;

a coil spring biasing said first and second links so that said pin exerts a force against said switch lever so that additional force is applied when said switch lever is moved to open the switch.

16. An improved mechanism for operating a switch from opened to closed and from closed to opened positions comprising:

a pivotably mounted toggle lever operably connected to the switch;

a pivotably mounted drive lever pivoted about the same axis as said toggle lever;

a spiral spring coaxial with and interconnecting said toggle and said drive levers;

first main latch means for releasably holding said toggle lever in the switch-closed position;

second main latch means for releasably holding said toggle lever in the switch-opened position;

biasing means connected to said drive lever for pivoting said drive lever in a first direction to bias said spring for switch opening and in a second direction to bias said spring for switch closing;

stop latch means for engaging and holding said drive lever after said biasing means has biased said spring in one direction;

first operator means for causing said first main latch means to release said toggle lever so that said toggle lever will pivot under the biasing of said spiral spring to open the switch;

second operator means for causing said second latch means to release said toggle lever so that said toggle lever will pivot under the biasing of said spiral spring to close the switch.

17. An improved mechanism, as claimed in claim 16, wherein said first operator means comprises a projection on said drive lever positioned to engage and release said first main latch from said toggle lever to open the switch when said drive lever has been pivoted in the first direction so that said spiral spring has been biased for switch opening.

18. An improved mechanism, as claimed in claim 16, wherein said second operator means comprises a projection on said drive lever positioned to engage and release said second main latch from said toggle lever to close the switch when said drive lever has been pivoted in the second direction so that said spiral spring has been biased for switch closing.

19. An improved mechanism, as claimed in claim 17, wherein said biasing means comprises a hand crank tool that is engageable with said drive lever to rotate said drive lever in the first direction until the switch opens, said tool being disengageable from said drive lever until said drive lever has been pivoted by said tool in the second direction until said stop latch means engages said drive lever so that said spring is biased ready for switch closing.

20. An improved mechanism, as claimed in claim 18, wherein said biasing means comprises a hand crank tool that is engageable with said drive lever to rotate said drive lever in the second direction until the switch closes, said tool being disengageable from said drive lever until said drive lever has been pivoted by said tool in the first direction until said stop latch means engages said drive lever so that said spiral spring is biased ready for switch opening.

* * * * *